US006354473B1

(12) United States Patent
Brambach et al.

(10) Patent No.: US 6,354,473 B1
(45) Date of Patent: Mar. 12, 2002

(54) CLOSING VALVE FOR A CONTAINER

(75) Inventors: Johan Arie Brambach, Leimuiden; Hubertus Josef F. Hanssen, Amsterdam; Edwin Nieuwenhuizen, Hoofddorp, all of (NL)

(73) Assignee: Euro Maintenance Lease Produktie B.V., Aalsmeer (NL)

( * ) Notice: Subject to any disclaimer, the term of this patent is extended or adjusted under 35 U.S.C. 154(b) by 0 days.

(21) Appl. No.: 09/762,129

(22) PCT Filed: Aug. 4, 1999

(86) PCT No.: PCT/NL99/00498

§ 371 Date: Mar. 12, 2001

§ 102(e) Date: Mar. 12, 2001

(87) PCT Pub. No.: WO94/29215

PCT Pub. Date: Dec. 22, 1994

(30) Foreign Application Priority Data

Aug. 5, 1998 (NL) ..... 1009812

(51) Int. Cl.[7] ..... B67D 5/00

(52) U.S. Cl. ..... 222/507; 222/523; 222/559; 141/349; 251/149.1

(58) Field of Search ..... 222/507, 523, 222/559; 141/348, 349; 251/149.1

(56) References Cited

U.S. PATENT DOCUMENTS 3,055,405 A * 9/1962 Pase ..... 141/349
4,375,864 A * 3/1983 Savage ..... 222/81
4,660,803 A * 4/1987 Johnston et al. ..... 251/149.1
4,667,925 A * 5/1987 Gaita ..... 251/149.1
5,213,309 A * 5/1993 Makishima ..... 251/149.1
5,370,270 A * 12/1994 Adams et al. ..... 222/88
5,579,953 A 12/1996 Perkins ..... 222/1
6,126,045 A * 10/2000 Last ..... 251/149.1

FOREIGN PATENT DOCUMENTS

FR 2 491 191 A 4/1982
WO WO 94 29215 A 12/1994

* cited by examiner

*Primary Examiner*—J. Casimer Jacyna
(74) *Attorney, Agent, or Firm*—Weingarten, Schurgin, Gagnebin & Lebovici LLP

(57) ABSTRACT

A closing valve for a container comprises a closing jacket connected therewith, which closing jacket is provided on the inside with a narrowed and a widened portion, and a valve part movable in this closing jacket. This valve part has a closing element and a clamping element which is provided on at least the outside with a thickening which, when the passage through the closing jacket is sealed by the valve part, cooperates with the widened portion in the closing jacket. Furthermore, a head part movable in the closing jacket back and forth is provided, by means of which the valve part can be moved with respect to the closing jacket such that the passage therethrough can be released and/or closed, while when releasing the passage through the closing jacket, the thickening on the outside of the clamping element is brought into the narrowed portion of the closing jacket, as a result of which the clamping element reaches a position in which it is engaged by the head part.

10 Claims, 3 Drawing Sheets

CLOSING VALVE FOR A CONTAINER

This application was originally filed as international application PCT/NL99/00498 on Aug. 4, 1999.

BACKGROUND OF THE INVENTION

The present invention relates to a closing valve for a container or a pipe system, comprising a closing jacket connectable to an opening in the container or forming part of the container, which closing jacket is provided on the inside with a narrowed and a widened portion, and a valve part movable in this closing jacket with a closing element and a clamping element rigidly connected therewith and extending in the closing jacket, which clamping element is provided on at least the outside with a thickening which, when the passage through the closing jacket is sealed by the valve part, is in contact with the widened portion in the closing jacket, while, furthermore, a head part movable back and forth in the closing jacket, optionally to be put into circulation apart, is provided, by means of which the valve part can be moved with respect to the closing jacket such that the passage therethrough can be released and/or closed.

Such a container may be a cardboard, metal or plastic packing as well as a compressible plastic bag, a glass, bottle and the like. The container is suitable for gaseous products as well as all kinds of liquids, optionally mixed with gas, both under pressure and under vacuum, highly viscous substances, such as puree, and further granulates, granular material, etc. The closing valve may also be included in a pipe system.

A closing valve as described in the opening paragraph is known from WO94/29215. In said document a thickening at the outside of the clamping element has the function to lock a head part with a tube relative to a valve part in the form of a closing plug. Because said thickening only temporarily rests against the edge of the thickening, for a short time a counterforce, necessary to lock the head part with the tube relative to the valve part, is exerted. By pushing the close jacket in the first instance said thickening meets the edge of the narrowed part of the closing jacket. At that moment the head part with the tube is still free removable (FIG. 2). When the head part with the tube is pushed further, the head part is locked in the 'valve' part because the edge of the valve part engages a groove between the head part and the tube (FIG. 3). When thereafter the head part with the tube is pushed further again, said thickening being pressed along the edge of the narrowed part of the closing jacket, the container is fully opened as then the outlet opening in the tube is located in the container (FIG. 4). In the latter position there is no locking between the valve part with the head part on the one hand and the closing jacket at the other hand, so that the position of these parts relative to each other is not determined any longer and not adjustable at all. As the valve element is in the form of a closing plug, the outlet opening is brought in the tube, with the risk that when the tube is wrenched off the valve part, the valve part will fall into the container, which then cannot be closed again.

The object of the invention is to provide for such a container an efficiently and inexpensively producible closing valve, via which the container can be easily filled and closed and the substances contained therein can be easily poured out or pressed or sucked out of the container, and by means of which closing valve the above problems are obviated.

To this end, according to the invention the closing valve is characterized in that, the thickening on the outside of the clamping element is located near the upper part of the clamping element, such that, when the passage through the closing jacket is released, the thickening on the outer side of the clamping element is brought into the narrowed portion of the closing jacket, as a result of which the clamping element reaches a position in which it is engaged by the head part.

The closing vale is therefore opened by pushing down the valve part by means of the head part, while by pulling up the head part, which as then engaged the clamping element, the valve part is taken along and the closing valve is gradually closed. The head part can therefore also be designed as a tap and brought into several positions and optionally fixed in these positions with respect to the closing jacket, so that gradually opening and closing the passage by the closing jacket becomes possible.

Although it is sufficient for specific uses to only open the container by means of the head part, in which connection it is not important that the valve part lands in the container, it is important for many other uses that the head part is provided with locking means for preventing the valve part from being pushed completely out of the closing jacket.

As appears from the foregoing, the closing valve, in its basic structure, is composed of only three easily producible parts: a closing jacket, a valve part and a head part; moreover, an inexpensive final product can be obtained by, for instance, injection molding these parts from some hard plastic. Of course, it remains possible that the closing jacket forms part of the container and/or that the head part forms part of a draw-off tap.

For many uses the head part will be provided with a throughbore which, at the lower end, is in open communication with the inside of the closing jacket, so that, when the closing valve is opened by pushing in the head part, an open communication with the atmosphere results, to which optionally other filling, outlet or pouring means or the like can be connected. In a favorable embodiment the head part is provided with a widened upper part which, when the valve part is pushed out of the closing jacket at least partially, seals the upper side of the closing element.

In addition to the three above basic parts, further parts may be provided, such as a sealing element to be arranged between the closing jacket and the head part, in particular an O-ring, to enable a fluid-tight closure. Further sealing elements, for instance around the peripheral edge of the closing element, may be provided; these sealing elements, however, may also be formed by, for instance, plastic edges forming part of the relevant components.

Although the clamping element may be cylindrical, while an annular thickening may be provided on the outside as well as on the inside, it is difficult to push in such a clamping element on all sides; anyhow, the clamping element then needs to be rather easily deformable. It is better when the clamping element is finger-shaped, with each of the finger-shaped parts on the inside and outside being provided with a thickening. It is indeed easier to push in the individual fingers. The thickening on the inside then serves to facilitate engagement by the head part.

When the container is formed by an easily compressible packing, such as, for instance, a plastic bag to which the closing valve as hitherto defined is connected, and furthermore, this easily compressible packing is arranged in an outer packing which is not compressible or is relatively difficult to compress, the closing valve needs to be provided with additional means. To this end, according to the invention a collar element connectable to an outer envelope or forming part thereof is provided, which collar element fits around the closing jacket, while between the outer circumferential surface of the closing jacket and the inner circumferential surface of the collar element gas supply channels, in particular air supply channels, are provided, which are opened when releasing the passage in the closing jacket. This has the advantage that gas can flow into the space between the inner packing, this is the easily compressible packing, and the outer packing, so that, when a pump is connected to the head part, the inner packing can be easily emptied by sucking, while the inner packing is compressed. Also, gas can be forcibly brought into the above space to enable the contents to be pressed out of the inner packing. This is important when the head part is formed by a filling head or a tapping head of, for instance, a tapping plant for beverages.

BRIEF DESCRIPTION OF THE DRAWINGS

The invention will now be further explained with reference to the accompanying drawing in which.

DETAILED DESCRIPTION OF THE INVENTION

Figure 1A:
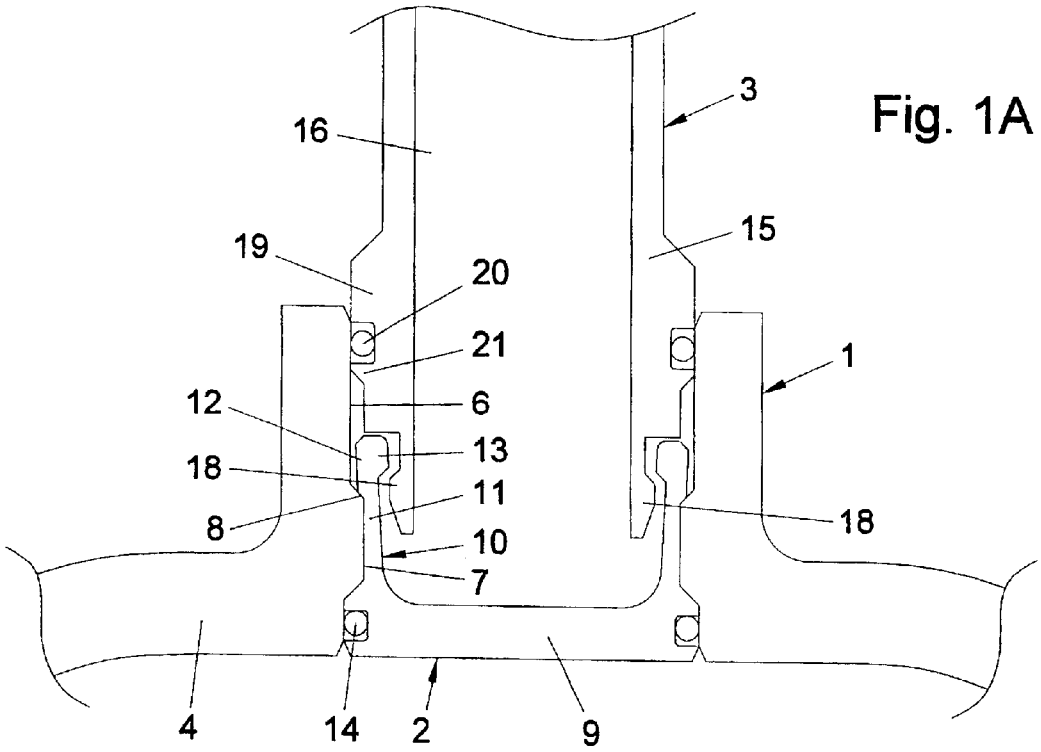
FIGS. 1A and 1B diagrammatically show a preferred embodiment of a closing valve according to the invention in the closed and the open position, respectively.

In the Figures, corresponding parts are designated by similar reference numerals.

The closing valve shown in the Figures and parts thereof comprise a closing jacket 1, a valve part 2 and a head part 3. In the embodiment shown, the closing jacket 1 is integral with a container 4. The closing jacket, however, can also be arranged as a loose part in an opening in the container by screwing or clamping or by means of a bayonet fit, etc. or be sealed with the container, for instance when it is formed by a plastic bag. The closing jacket is round-cylindrical in shape and has on the inside a widened portion 6 and a narrowed portion 7, which two portions are interconnected at the edge 8. The portion 6 having the larger inner diameter extends to the open end of the closing jacket 1, while the portion 7 having the smaller inner diameter extends to the opening in the container 4.

The valve part 2 is arranged in the closing jacket 1 for movement back and forth and comprises a closing element 9 and a clamping element 10. The clamping element 10 is formed here by finger-shaped parts 11 which extend from the closing element 9 into the cylindrical inner space of the closing jacket in the direction of the open end thereof. In the present embodiment, four of such finger-shaped elements 11 are provided, which are, somewhat yieldingly, integral with the closing element 9. At the end of these finger-shaped elements 11 are provided, which are, somewhat yieldingly, integral with the closing element 9. At the end of these finger-shaped elements 11 are provided, both on the outside and on the inside, thickenings 12 and 13, respectively.

To obtain a fluid-tight closure between the closing jacket 1 and the valve part 2, in particular the closing element 9, the closing element 9 is provided with a sealing element in the form of an O-ring 14.

In the closing jacket 1 the head part 3 is movable back and forth. This head part comprises a cylindrical body 15 with a throughbore 16, which, at the lower end, is in open communication with the inside of the closing jacket 1. The cylindrical body 15 is further provided with a lower thickening, forming locking means, on the outside in the form of a circular edge 18 and with a widened central portion in the form of a closing flange 19. By means of this closing flange 18 the inside of the closing jacket 1 can be closed by the head part 3. To obtain a fluid-tight closure between the two last-mentioned parts, a sealing element is provided in the form of an O-ring 20.

Figure 1B:
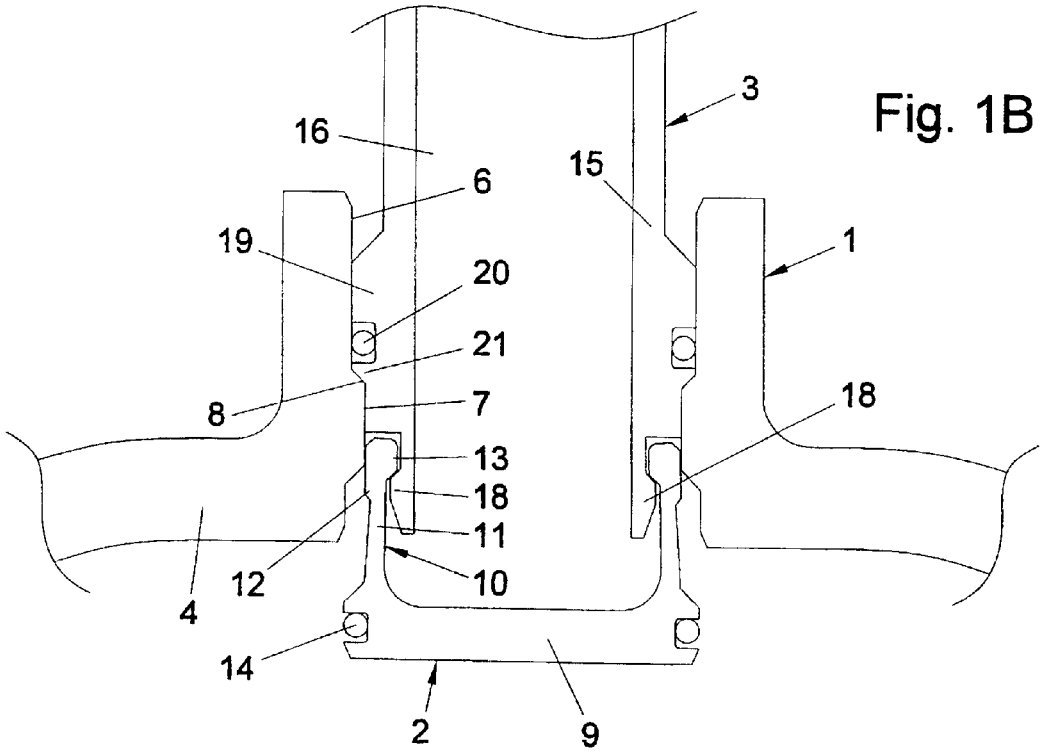
Figure 2:
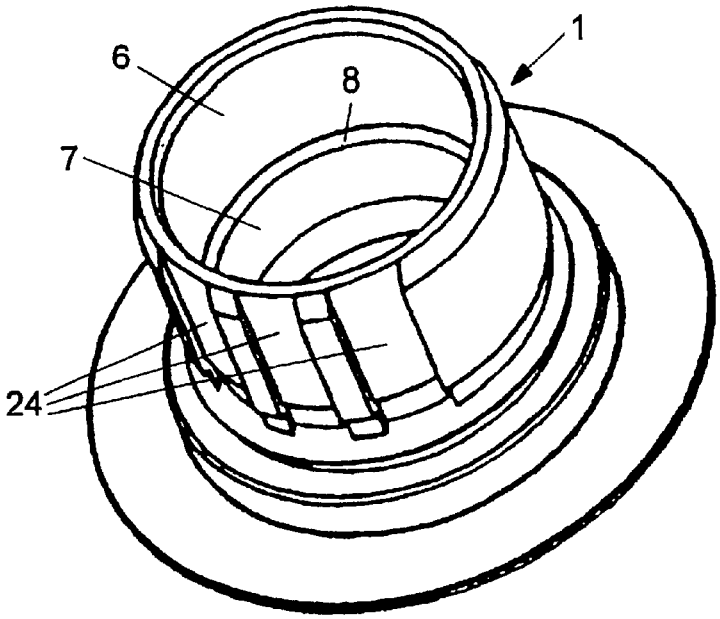
FIG. 2 is a perspective view of the closing jacket in the closing valve as shown in FIGS. 1A and 1B.
Figure 3:
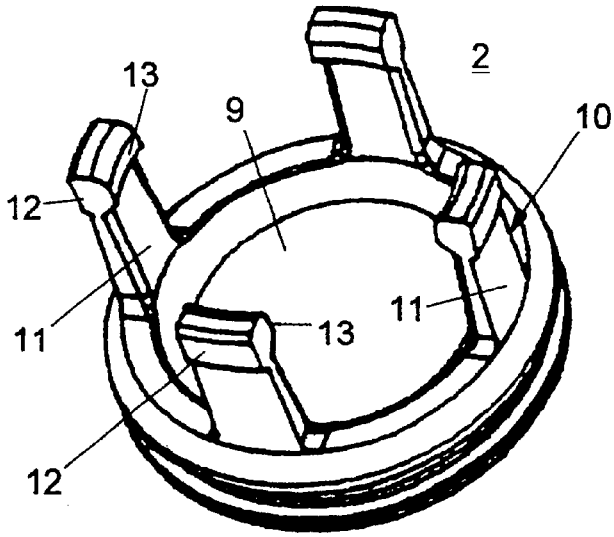
FIG. 3 is a perspective view of the valve part in this closing valve; wile

In FIG. 1A the valve part 2 and the head part 3 are in the position in which the container is closed and in which the head part 3 can be removed, if desired. In FIG. 1B the valve part and the head part are moved down to the lowest position in which a circular projecting edge 21 of the closing flange 19 rests on the edge 8 on the inside of the closing jacket 1, while the thickening 13 on the outside of the clamping element 10 is retained between the lower edge of the closing flange 19 and the upper side of the lower edge 18.

The operation of the closing valve is as follows:

When in the position shown in FIG. 1A the head part 3 is pushed down, that is to say in the direction of the opening in the container 4, the finger-shaped parts 11 are pulled in and the thickenings 12 pass the edge 8. The thickenings 13 of these finger-shaped parts 11 thereby engage behind the circular edge 18. The head part 3 and, with it, the valve part 2 can be pushed farther down, until the projecting edge 21 of the closing flange 19 gets stuck on the edge 8 of the closing jacket 1. The valve part 2 is then in the position shown in FIG. 1B, while the opening in the container 4 is released and outflow of the contents thereof via the throughbore 16 is possible. Because of the fact that the clamping element 10 is locked behind the edge 18, the valve part 2 can never move farther down and land in the container itself. When the container is to be closed again, it suffices to pull up the head part 3. The edge 18 thereby moves up the valve part 2, until the position shown in FIG. 1A is reached again.

Figure 4A:
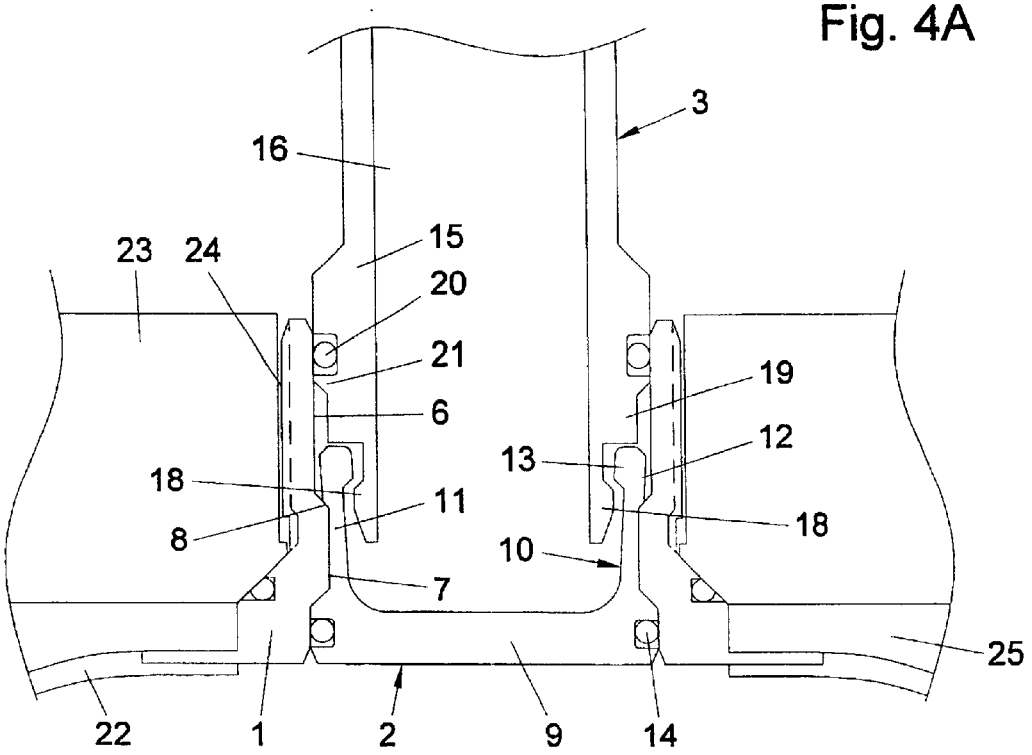
FIGS. 4A and 4B diagrammatically show the closing valve for a use in which this valve is arranged on an easily compressible inner packing and a non-compressible outer packing.
Figure 4B:
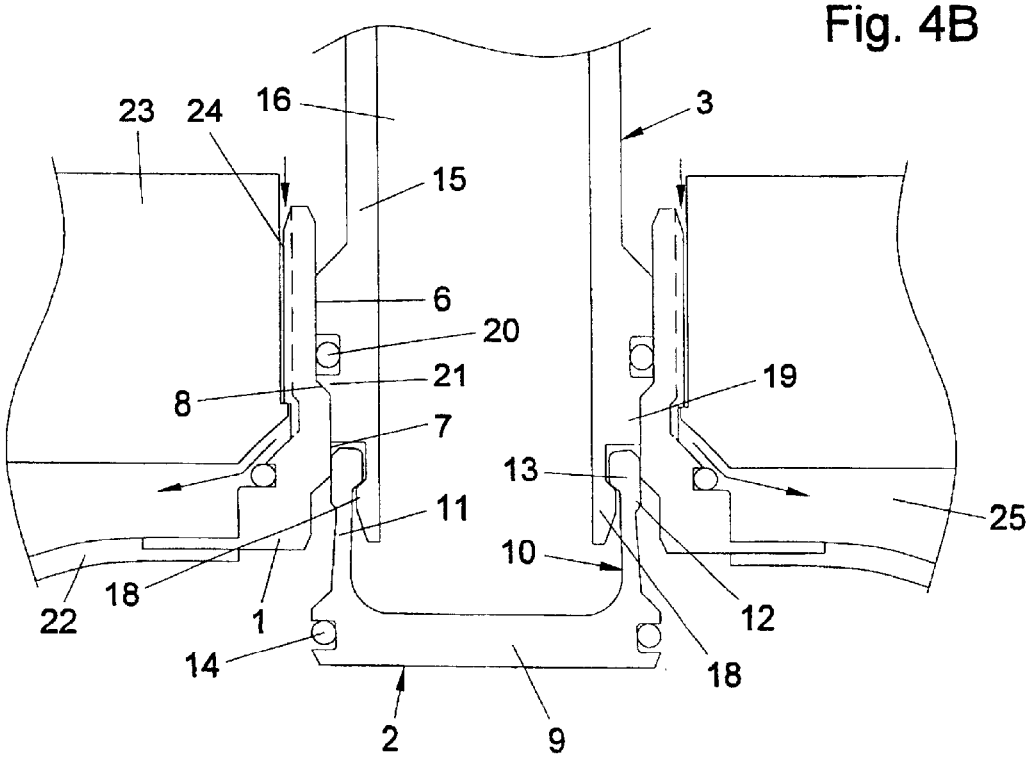

The closing valve described herein can be used in a double-walled packing as shown in FIGS. 4A and 4B. As appears from these Figures, a container 22 is rigidly connected with the closing jacket 1 of the closing valve. This container 22 is designed here as an easily compressible inner packing, such as a plastic bag. Disposed around the closing jacket 1 is a collar element 23 which is fixed, for instance by screwing, in a non-compressible outer packing. The collar element can also be integral with this outer packing. Provided between the outer circumferential surface of the closing jacket 1 and the inner circumferential surface of the collar element 23 are gas supply channels 24. Through these channels, when the contents flow out of the inner packing 21, a gas, often air, can flow or be pressed from outside into the space between the inner and outer packings in the direction indicated in FIG. 4B by arrows. Thus, when the contents are sucked out of the inner packing, air can automatically flow into the intermediate space. However, when a gas is passed under pressure into this intermediate space, the contents can be pressed out of the inner packing. In the position shown in FIG. 4A, in which the inner packing 22 is closed, the gas supply channels 24 are also closed. When the head part is moved down to open the inner packing 22, the closing jacket 1 is also moved down with respect to the collar element 23, as a result of which the gas supply channels 24 are released and a gas can flow or be pressed into the space 25 between the inner and outer packings. The embodiment shown in FIGS. 4A and 4B can, for instance, be used when the head part forms part of or can be fixed on a tapping head of, for instance, a tapping plant for beverages. It is indeed important there that opening of the inner packing is coupled with the introduction of a gas into the intermediate space 25.

The invention is not limited to the practical example described herein with reference to the drawing, but comprises all kinds of modifications thereof, of course as far as falling within the scope of protection of the annexed claims. In particular, it is observed that the head part 3 can be put into circulation apart from the container, with the closing jacket 1 and the valve part 2 in the closed condition; the head part, however, is necessary to open and close the container again in the manner as described herein. A round inner section of the closing jacket is not necessary. A polygonal or non-circular section is possible, provided it is ensured that the valve part and the head part are adjusted thereto in shape. Furthermore, it is not necessary to arrange a thickening on the inside of the clamping element; through a frictional force exerted on the clamping element during the closing movement the head part can move along the valve part and bring it into the position in which the container is closed.

What is claimed is:

1. A closing valve for a container or a pipe system, comprising a closing jacket connectable to an opening in the container or forming part of the container, which closing jacket is provided on the inside with a narrowed and a widened portion, and a valve part movable in this closing jacket with a closing element and a clamping element rigidly connected therewith and extending in the closing jacket, which clamping element is provided on at least the outside with a thickening which, when the passage through the closing jacket is sealed by the valve part, is in contact with the widened portion in the closing jacket, while, furthermore, a head part movable back and forth in the closing jacket, is provided, by means of which the valve part can be moved with respect to the closing jacket such that the passage therethrough can be released and/or closed, characterized in that the thickening on the outside of the clamping element is located near the upper part of the clamping element, such that, when the passage through the closing jacket is released, the thickening on the outside of the clamping element is brought into the narrowed portion of the closing jacket, as a result of which the clamping element reaches a position in which it is engaged by the head part.

2. A closing valve according to claim 1, characterized in that the head part can be brought into several positions with respect to the closing jacket, so that gradually opening and closing the passage by the closing jacket becomes possible.

3. A closing valve according to claim 2, characterized in that:

the head part is provided with locking means for preventing the valve part from being pushed completely out of the closing jacket;

the head part is provided with a throughbore which, at the lower end, is in open communication with the inside of the closing jacket;

the head part is provided with a widened central portion by means of which the closing jacket can be closed;

between the closing jacket and the head part a sealing element, in particular an O-ring, is provided to enable a fluid-tight closure;

the clamping element is finger-shaped, with each of the finger-shaped parts on the inside and outside being provided with a thickening;

a collar element connectable to an outer envelope or forming part thereof is provided, which collar element fits around the closing jacket, while between the outer circumferential surface of the closing jacket and the inner circumferential surface of the collar element gas supply channels are provided, which are opened when releasing the passage in the closing jacket; and the head part is formed by or forms part of a filling head or a tapping head.

4. A closing valve according to claim 1, characterized in that the head part is provided with locking means for preventing the valve part from being pushed completely out of the closing jacket.

5. A closing valve according to claim 1, characterized in that the head part is provided with a throughbore which, at the lower end, is in open communication with the inside of the closing jacket.

6. A closing valve according to claim 1, characterized in that the head part is provided with a widened central portion by means of which the closing jacket can be closed.

7. A closing valve according to claim 1, characterized in that between the closing jacket and the head part a sealing element, in particular an O-ring, is provided to enable a fluid-tight closure.

8. A closing valve according to claim 1, characterized in that the clamping element is finger-shaped, with each of the finger-shaped parts on the inside and outside being provided with a thickening.

9. A closing valve according to claim 1, characterized in that a collar element connectable to an outer envelope or forming part thereof is provided, which collar element fits around the closing jacket, while between the outer circumferential surface of the closing jacket and the inner circumferential surface of the collar element gas supply channels are provided, which are opened when releasing the passage in the closing jacket.

10. A closing valve according to claim 1, characterized in that the head part is formed by or forms part of a filling head or a tapping head.

* * * * *

UNITED STATES PATENT AND TRADEMARK OFFICE

CERTIFICATE OF CORRECTION

PATENT NO. : 6,354,473 B1
DATED : March 12, 2002
INVENTOR(S) : Johan Arie Brambach et al.

It is certified that error appears in the above-identified patent and that said Letters Patent is hereby corrected as shown below:

Column 2,
Line 7, “vale” should read -- valve --;
Line 9, “as” should read -- has --;

Column 3,
Line 27, “wile” should read -- while --.

Signed and Sealed this

Twenty-sixth Day of August, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,354,473 B1
DATED : March 12, 2002
INVENTOR(S) : Johan Arie Brambach et al.

It is certified that error appears in the above-identified patent and that said Letters Patent is hereby corrected as shown below:

Title page,
Item [87], PCT Pub. No.:, "WO94/29215" should read -- WO00/07902 --;
Item [87], PCT Pub. Date:, "Dec. 22, 1994" should read -- Feb. 17, 2000 --;

Column 3,
Lines 60-62, delete "which are, somewhat yieldingly, integral with the closing element 9. At the end of these finger-shaped elements 11 are provided,".

Signed and Sealed this

Twenty-fourth Day of August, 2004

JON W. DUDAS
*Director of the United States Patent and Trademark Office*